US010170048B2

(12) United States Patent
Lee et al.

(10) Patent No.: US 10,170,048 B2
(45) **Date of Patent: *Jan. 1, 2019**

(54) PIXEL AND ORGANIC LIGHT-EMITTING DIODE (OLED) DISPLAY HAVING THE SAME

(71) Applicant: Samsung Display Co., Ltd., Yongin-si, Gyeonggi-do (KR)

(72) Inventors: Jae-Sic Lee, Cheonan-si (KR); Seung-Kyu Lee, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 88 days.

This patent is subject to a terminal disclaimer.

(21) Appl. No.: 15/263,914

(22) Filed: Sep. 13, 2016

(65) Prior Publication Data

US 2016/0379569 A1 Dec. 29, 2016

Related U.S. Application Data

(63) Continuation of application No. 14/656,449, filed on Mar. 12, 2015, now Pat. No. 9,460,662.

(30) Foreign Application Priority Data

Apr. 4, 2014 (KR) ..... 10-2014-0040394

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 3/3275; G09G 3/3225
(Continued)

(56) References Cited

U.S. PATENT DOCUMENTS 9,318,054 B2 * 4/2016 Lee ..... G09G 3/3233
9,324,275 B2 4/2016 Kwak et al.
(Continued)

FOREIGN PATENT DOCUMENTS

JP 2011-181283 A 9/2011
JP 5384051 B2 10/2013
(Continued)

*Primary Examiner* — Fred Tzeng
(74) *Attorney, Agent, or Firm* — Lewis Roca Rothgerber Christie LLP

(57) ABSTRACT

A pixel and an organic light-emitting diode (OLED) display having the same are disclosed. In one aspect, a pixel includes an OLED including an anode and a cathode and configured to emit light corresponding to data signals applied during first and second frame periods. Each of the first and second frame periods includes a first discharge period and a light-emitting period subsequent to the first discharge period. The pixel also includes a pixel circuit configured to control light emission of the OLED, apply a first voltage to the anode during the light-emitting period, apply a second voltage to the cathode, the second voltage having a voltage level less than that of the first voltage, and apply a third voltage to the anode so as to discharge the anode during the first discharge period. The second voltage has different voltage levels during the first and second frame periods.

17 Claims, 9 Drawing Sheets

(51) Int. Cl.
*G09G 3/3233* (2016.01)
*G09G 3/3275* (2016.01)
*G09G 3/3291* (2016.01)

(52) U.S. Cl.
CPC ..... *G09G 3/3275* (2013.01); *G09G 3/3291* (2013.01); *G09G 2300/0819* (2013.01); *G09G 2300/0861* (2013.01); *G09G 2310/0251* (2013.01); *G09G 2320/0233* (2013.01); *G09G 2320/0238* (2013.01); *G09G 2330/028* (2013.01)

(58) Field of Classification Search
USPC ..... 345/77
See application file for complete search history.

(56) References Cited

U.S. PATENT DOCUMENTS 9,336,715 B2 5/2016 Han
9,460,662 B2 * 10/2016 Lee ..... G09G 3/3233
2002/0018033 A1 2/2002 Tanaka et al.
2006/0208977 A1 9/2006 Kimura
2007/0296672 A1 * 12/2007 Kim ..... G09G 3/3233 345/92
2008/0111812 A1 5/2008 Shirasaki et al.
2008/0246785 A1 * 10/2008 Shirasaki ..... G09G 3/3233 345/690
2010/0013816 A1 * 1/2010 Kwak ..... G09G 3/3233 345/211
2013/0169516 A1 * 7/2013 Chen ..... G09G 3/3258 345/76
2013/0222356 A1 8/2013 Jeong et al.
2014/0139510 A1 * 5/2014 Han ..... G09G 3/3233 345/212
2014/0292734 A1 * 10/2014 Pyon ..... G09G 3/3233 345/211
2015/0029079 A1 1/2015 Miyazawa et al.
2015/0255012 A1 9/2015 Gu et al.
2015/0310834 A1 * 10/2015 Hu ..... G09G 3/3225 345/205
2015/0348463 A1 12/2015 Lee
2015/0371606 A1 * 12/2015 Lee ..... G09G 3/3233 345/690

FOREIGN PATENT DOCUMENTS

KR 10-2008-0000294 A 1/2008
KR 10-2010-0077649 A 7/2010
KR 10-2012-0008085 A 1/2012

* cited by examiner

PIXEL AND ORGANIC LIGHT-EMITTING DIODE (OLED) DISPLAY HAVING THE SAME

INCORPORATION BY REFERENCE TO ANY PRIORITY APPLICATIONS

This application is a continuation of U.S. patent application Ser. No. 14/656,449, filed Mar. 12, 2015, now U.S. Pat. No. 9,460,662 issued on Oct. 4, 2016, which claims the benefit of Korean Patent Application No. 10-2014-0040394, filed on Apr. 4, 2014, each disclosure of which is incorporated herein in their entirety by reference.

BACKGROUND

Field

The described technology generally relates to a pixel and an organic light-emitting diode (OLED) display having the same.

Description of the Related Technology

Each pixel in an OLED display includes an OLED and a pixel circuit that controls the OLED. The pixel circuit typically includes a switching transistor, a driving transistor, and a storage capacitor.

The OLED includes an anode, a cathode, and an organic light-emitting layer formed between the anode and the cathode. The OLED emits light when a voltage greater than a threshold voltage of the organic light-emitting layer is applied to between the anode and the cathode.

SUMMARY OF CERTAIN INVENTIVE ASPECTS

One inventive aspect is a pixel capable of substantially uniformly displaying a black brightness.

Another aspect is an organic light-emitting diode (OLED) display having the pixel.

Another aspect is a pixel that emits a light corresponding to data signals provided during first and second frame periods. Each of the first and second frame periods includes a light emitting period and a first discharge period prior to the light emitting period. The pixel includes an organic light emitting diode and a pixel circuit to control the light emission of the organic light emitting diode.

The organic light emitting diode includes an anode applied with a first voltage during the light emitting period and a cathode applied with a second voltage having a voltage level lower than the first voltage. The second voltage has different voltage levels during the first and second frame periods. The anode of the organic light emitting diode is discharged by a third voltage having a constant electric potential difference against the second voltage during the first discharge period.

The pixel circuit includes a driving transistor that includes an input electrode applied with a first voltage during the light emitting period, an output electrode, and a control electrode connected to a first node, a switching transistor that includes an input electrode applied with the data signals, an output electrode connected to the input electrode of the driving transistor, and a control electrode applied with a scan signal activated in a scan period prior to the first discharge period, a storage capacitor connected between the first node and a second node applied with the first voltage, a first control transistor that includes an input electrode connected to the output electrode of the driving transistor, an output electrode connected to the first node, and a control electrode applied with the scan signal, a second control transistor that includes an input electrode connected to the output electrode of the driving transistor, an output electrode connected to the anode of the organic light emitting diode, and a control electrode applied with a light emitting control signal activated in the light emitting period, and a first discharge transistor that includes an input electrode applied with the third voltage, an output electrode connected to the anode of the organic light emitting diode, and a control electrode applied with a first discharge control signal activated in the first discharge period, and applies the third voltage to the anode of the organic light emitting diode during the first discharge period.

The pixel circuit further includes a second discharge transistor that includes an input electrode applied with a fourth voltage having a voltage level lower than the data signals, an output electrode connected to the first node, and a control electrode applied with a second discharge control signal activated in a second discharge period prior to the scan period. The second discharge transistor applies the fourth voltage to the first node during the second discharge period.

The pixel circuit further includes a third control transistor that includes an input electrode connected to the second node, an output electrode connected to the input electrode of the driving transistor, and a control electrode applied with the light emitting control signal.

The electric potential difference between the second voltage and the third voltage is smaller than a light emitting threshold voltage of the organic light emitting diode.

Another aspect is an organic light emitting display device including a scan driver, a data driver, pixels, and a discharge voltage generator. Each pixel can be substantially the same as the above-mentioned pixel. The scan driver outputs scan signals and light emitting control signals during first and second frame periods. The data driver outputs data signals during the first and second frame periods. The discharge voltage generator applies a third voltage having a constant electric potential difference against the second voltage to the pixels during the first and second frame periods.

Among the pixels, the anode of the organic light emitting diode of a first pixel connected to an i-th scan line of the scan lines, a light emitting line corresponding to the i-th scan line, and a j-th data line of the data lines is discharged by a third voltage during a first discharge period prior to the light emitting period of the first and second frame periods.

The first discharge control signal can be the scan signal applied to the scan line formed after the i-th scan line. The second discharge control signal can be the scan signal applied to the scan line formed before the i-th scan line.

The discharge voltage generator includes a first discharge voltage generator to generate the third voltage. The first discharge voltage generator includes a differential amplifier configured to include an inverting input terminal applied with a reference voltage, a non-inverting input terminal applied with the second voltage, and an output terminal that outputs a voltage difference between the reference voltage and the second voltage as the third voltage.

The discharge voltage generator further includes a second discharge voltage generator to generate the fourth voltage. The second discharge voltage generator further includes a voltage dividing circuit including a plurality of resistors connected in series between the first voltage and the second voltage to output the fourth voltage divided by the resistors.

Among the pixels, a second pixel different from the first pixel includes an organic light emitting diode emitting a light having a different color from that of the organic light emitting diode of the first pixel. During the first frame period, a cathode of the organic light emitting diode of the second pixel receives the second voltage having the voltage level different from the voltage level of the second voltage applied to the cathode of the organic light emitting diode of the first pixel.

During the first frame period, an anode of the organic light emitting diode of the second pixel is discharged by the third voltage having the voltage level different from the voltage level of the third voltage used to discharge the anode of the organic light emitting diode of the first pixel during the first frame period.

According to the above, the cathode of the organic light emitting diode receives the second voltage having the different voltage levels in different frame periods. The voltage level of the second voltage is determined depending on the pixel or the operation mode of the organic light emitting display device.

The anode of the organic light emitting diode is discharged to the voltage having the constant electric potential difference against the second voltage before the organic light emitting diode emits the light. Then, the organic light emitting diode emits the light in response to the data signal. The organic light emitting diode displays the brightness corresponding to the gray-scale value of the data signal. For instance, the organic light emitting diode can uniformly display the black brightness. The organic light emitting diode can display low gray-scales, each having a predetermined brightness difference against the black brightness.

The anodes of the organic light emitting diodes, which display different colors, receive the second voltages having different voltage levels. The anodes of the organic light emitting diodes are discharged by voltages each having the electric potential difference against the corresponding second voltage.

Another aspect is a pixel for an organic light-emitting diode (OLED) display, comprising an OLED and a pixel circuit. The OLED includes an anode and a cathode and is configured to emit light corresponding to data signals applied during first and second frame periods, wherein each of the first and second frame periods includes a first discharge period and a light-emitting period subsequent to the first discharge period. The pixel circuit is configured to i) control light emission of the OLED, ii) apply a first voltage to the anode during the light-emitting period, iii) apply a second voltage to the cathode, the second voltage having a voltage level less than that of the first voltage, wherein the second voltage has different voltage levels during the first and second frame periods, and iv) apply a third voltage to the anode so as to discharge the anode during the first discharge period, wherein the difference between the second and third voltages is substantially constant during the first discharge period.

In the above pixel, the pixel circuit comprises a driving transistor, a switching transistor, a storage capacitor, a first control transistor, a second control transistor, and a first discharge transistor. In the above pixel, the driving transistor includes an input electrode configured to receive a first voltage during the light emitting period, an output electrode, and a control electrode electrically connected to a first node. In the above pixel, the switching transistor includes an input electrode configured to receive the data signals, an output electrode electrically connected to the input electrode of the driving transistor, and a control electrode configured to receive a scan signal comprising an active voltage level in a scan period preceding the first discharge period. In the above pixel, the storage capacitor is electrically connected between the first node and a second node applied with the first voltage. In the above pixel, the first control transistor includes i) an input electrode electrically connected to the output electrode of the driving transistor, ii) an output electrode electrically connected to the first node, and iii) a control electrode configured to receive the scan signal. In the above pixel, the second control transistor includes i) an input electrode electrically connected to the output electrode of the driving transistor, ii) an output electrode electrically connected to the anode of the OLED, and iii) a control electrode configured to receive a light-emitting control signal comprising an active voltage level in the light emitting period. In the above pixel, the first discharge transistor include i) an input electrode configured to receive the third voltage, ii) an output electrode electrically connected to the anode of the OLED, and iii) a control electrode configured to receive a first discharge control signal comprising an active voltage level in the first discharge period, wherein the first discharge transistor is configured to apply the third voltage to the anode of the OLED during the first discharge period.

In the above pixel, the pixel circuit further comprises a second discharge transistor including i) an input electrode configured to receive a fourth voltage having a voltage level lower than that of the data signals, ii) an output electrode electrically connected to the first node, and iii) a control electrode configured to receive a second discharge control signal comprising an active voltage level in a second discharge period preceding the scan period, wherein the second discharge transistor is configured to apply the fourth voltage to the first node during the second discharge period.

In the above pixel, the pixel circuit further comprises a third control transistor including i) an input electrode electrically connected to the second node, ii) an output electrode electrically connected to the input electrode of the driving transistor, and iii) a control electrode configured to receive the light-emitting control signal.

In the above pixel, the second voltage comprises a voltage level in a range of about −4 volts to about −2 volts.

In the above pixel, the difference between the second voltage and the third voltage is less than a light-emitting threshold voltage of the OLED.

Another aspect is an OLED display comprising a plurality of scan lines, a plurality of light-emitting lines, a scan driver configured to sequentially respectively apply a plurality of scan signals to the scan lines during first and second frame periods and respectively apply a plurality of light-emitting control signals to the light-emitting lines, a plurality of data lines crossing the scan lines and the light-emitting lines, a data driver configured to respectively apply a plurality of data signals to the data lines during the first and second frame periods, wherein the data lines cross the scan lines so as to be insulated therefrom. The OLED display further comprises a plurality of pixels including a first pixel electrically connected to an i-th scan line of the scan lines, a light-emitting line corresponding to the i-th scan line, and a j-th data line of the data lines. Each pixel includes an OLED and a pixel circuit. The OLED includes an anode configured to receive a first voltage during a light-emitting period of the first and second frame periods and a cathode configured to receive a second voltage having a voltage level lower than that of the first voltage, wherein the first and second voltages have different voltage levels during the first and second frame periods. The pixel circuit is configured to control light emission of the OLED. The OLED display further comprises a discharge voltage generator configured to apply a third voltage to the pixels during the first and second frame periods, wherein the difference between the second and third voltages is substantially constant, wherein a corresponding pixel circuit is configured to apply a third voltage so as to discharge the anode during a first discharge period preceding the light-emitting period of the first and second frame periods.

In the above OLED display, the pixel circuit of the first pixel comprises a driving transistor, a switching transistor, a storage capacitor, first and second control transistors, and a first discharge transistor. In the above OLED display, the driving transistor includes i) an input electrode configured to receive the first voltage, ii) an output electrode, and iii) a control electrode electrically connected to a first node. In the above OLED display, the switching transistor includes i) an input electrode configured to receive the data signal applied to the j-th data line, ii) an output electrode electrically connected to the input electrode of the driving transistor, and iii) a control electrode configured to receive a scan signal applied to the i-th scan line and comprising an active voltage level in a scan period preceding the first discharge period. In the above OLED display, the storage capacitor in electrically connected between the first node and a second node applied with the first voltage. In the above OLED display, the first control transistor includes i) an input electrode electrically connected to the output electrode of the driving transistor, ii) an output electrode electrically connected to the first node, and iii) a control electrode configured to receive the scan signal applied to the i-th scan line. In the above OLED display, the second control transistor includes i) an input electrode electrically connected to the output electrode of the driving transistor, ii) an output electrode electrically connected to the anode of the OLED, and iii) a control electrode configured to receive a light-emitting control signal comprising an active voltage level in the light-emitting period and apply the light-emitting control signal to the light-emitting line corresponding to the i-th scan line. In the above OLED display, the first discharge transistor includes i) an input electrode configured to receive the third voltage, ii) an output electrode electrically connected to the anode of the OLED, and iii) a control electrode configured to receive a first discharge control signal comprising an active voltage level in the first discharge period, wherein the first discharge transistor is configured to apply the third voltage to the anode of the OLED during the first discharge period.

In the above OLED display, the first discharge control signal comprises the scan signal applied to the scan line immediately subsequent to the i-th scan line.

In the above OLED display, the pixel circuit of the first pixel further comprises a second discharge transistor including i) an input electrode configured to receive a fourth voltage having a voltage level less than that of the data signal applied to the j-th data line, ii) an output electrode electrically connected to the first node, and iii) a control electrode configured to receive a second discharge control signal comprising an active voltage level in a second discharge period prior to the scan period, wherein the second discharge transistor is configured to apply the fourth voltage to the first node during the second discharge period.

In the above OLED display, the second discharge control signal comprises the scan signal applied to the scan line immediately preceding the i-th scan line. In the above OLED display, the pixel circuit of the first pixel further comprises a third control transistor including i) an input electrode electrically connected to the second node, ii) an output electrode electrically connected to the input electrode of the driving transistor, and iii) a control electrode configured to receive the light-emitting control signal applied to the light-emitting line corresponding to the i-th scan line.

In the above OLED display, the discharge voltage generator is configured to output the fourth voltage.

In the above OLED display, the discharge voltage generator comprises a first discharge voltage generator configured to generate the third voltage and comprising a differential amplifier including i) an inverting input terminal configured to receive a reference voltage, ii) a non-inverting input terminal configured to receive the second voltage, and iii) an output terminal configured to output a voltage difference between the reference voltage and the second voltage as the third voltage.

In the above OLED display, the discharge voltage generator further comprises a second discharge voltage generator configured to generate the fourth voltage and comprising a voltage dividing circuit including a plurality of resistors electrically connected in series between the first voltage and the second voltage so as to output the fourth voltage divided by the resistors.

In the above OLED display, the second voltage comprises a voltage level in a range of about −4 volts to about −2 volts.

In the above OLED display, the difference between the second voltage and the third voltage is less than a light-emitting threshold voltage of the OLED of the first pixel.

In the above OLED display, a second pixel, different from the first pixel among the pixels, comprises an OLED configured to emit light having a color different from that of the OLED of the first pixel, wherein a cathode of the OLED of the second pixel is configured to receive a second voltage having the voltage level different from the voltage level of the second voltage applied to the cathode of the OLED of the first pixel during the first frame period.

In the above OLED display, the pixel circuit of the second pixel is configured to apply a third voltage of the second pixel to an anode of the OLED so as to discharge the anode, wherein the third voltage of the second pixel is different from the third voltage of the first pixel.

Another aspect is an OLED display comprising a plurality of scan lines, a plurality of light-emitting lines, a scan driver configured to sequentially respectively apply a plurality of scan signals to the scan lines and respectively apply a plurality of light-emitting control signals to the light-emitting lines, a plurality of data lines crossing the scan lines and the light-emitting lines, a data driver configured to respectively apply a plurality of data signals to the data lines, a plurality of pixels, and a discharge voltage generator. Each pixel includes an OLED and a pixel circuit. The OLED includes an anode configured to receive a first voltage during a light-emitting period and a cathode configured to receive a second voltage having a voltage level lower than that of the first voltage. The pixel circuit is configured to control light emission of the OLED. The discharge voltage generator is configured to output a third voltage, wherein the difference between the second and third voltages is substantially constant, and wherein the pixel circuit is further configured to apply the third voltage to the anode so as to discharge the anodes during a first discharge period preceding the light-emitting period.

According to at least one embodiment, the OLEDs can uniformly display the black brightness.

DETAILED DESCRIPTION OF CERTAIN INVENTIVE EMBODIMENTS

Figure 1:
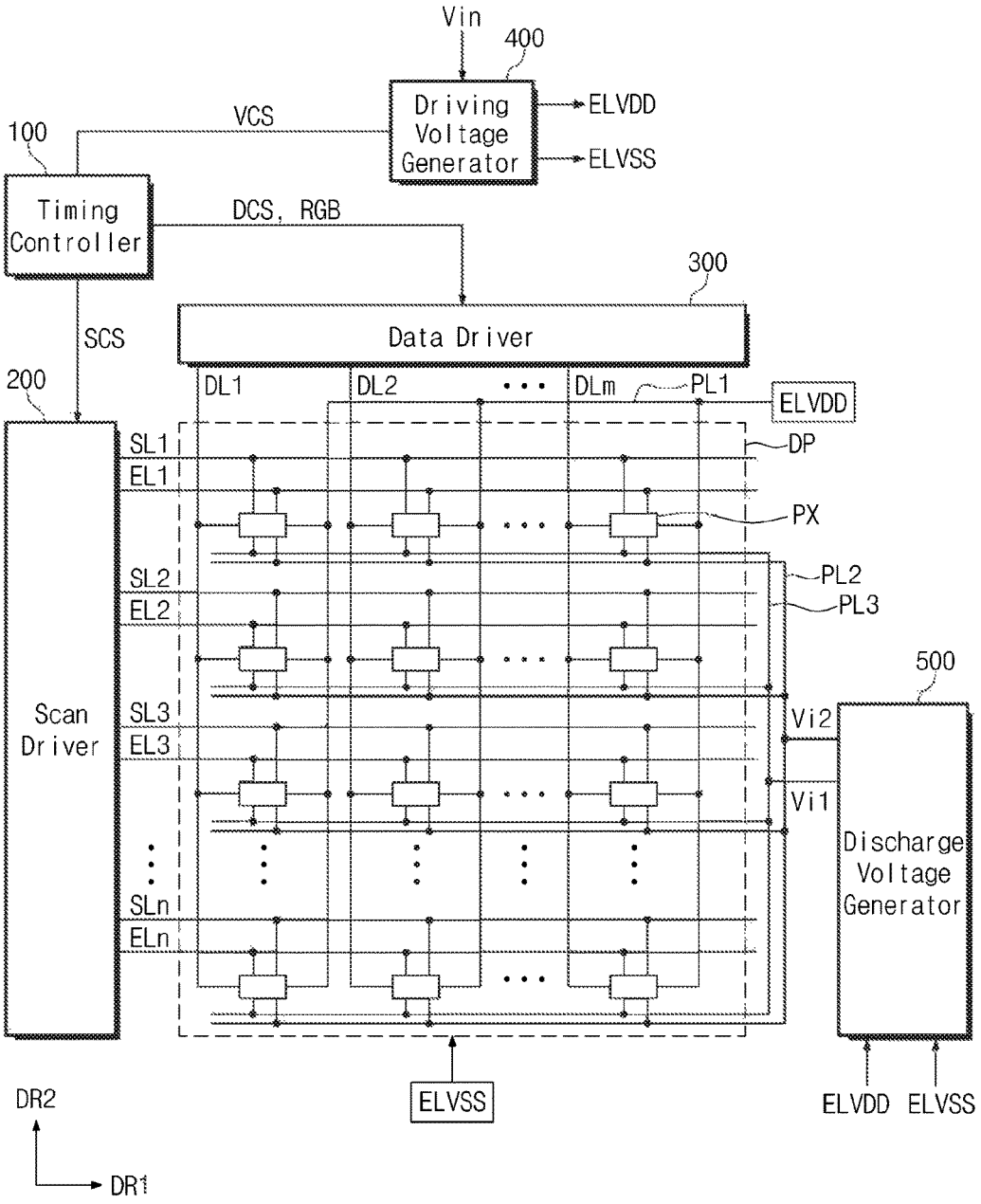
FIG. 1 is a block diagram showing an OLED display according to an exemplary embodiment.

It will be understood that when an element or layer is referred to as being "on", "connected to" or "coupled to" another element or layer, it can be directly on, connected or coupled to the other element or layer or intervening elements or layers can be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the described technology.

Spatially relative terms, such as "beneath", "below", "lower", "above", "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device can be otherwise oriented (rotated 90 degrees or at other orientations) and the spatially relative descriptors used herein interpreted accordingly.

The terminology used herein is for the purpose of describing particular embodiments only and is not intended to be limiting of the described technology. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Hereinafter, the described technology will be explained in detail with reference to the accompanying drawings.

Figure 2:
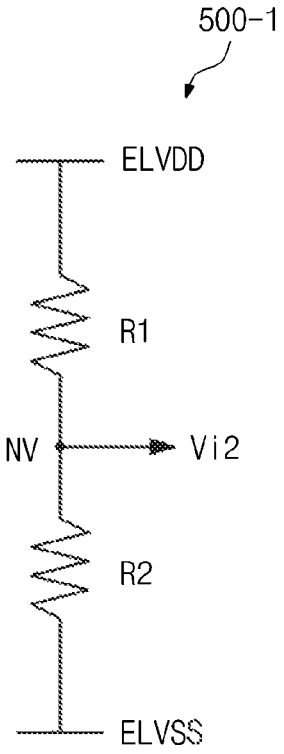
FIG. 2 is a circuit diagram showing a first discharge voltage according to an exemplary embodiment.
Figure 3A:
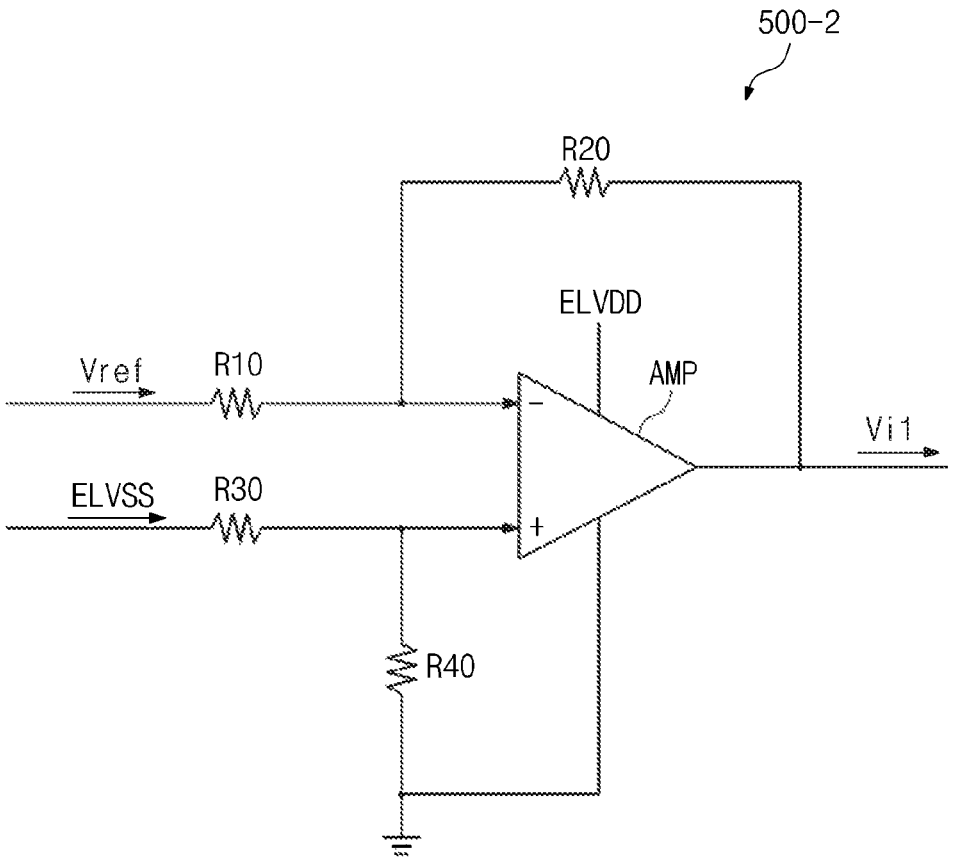
FIG. 3A is a circuit diagram showing a second discharge voltage according to an exemplary embodiment.
Figure 3B:
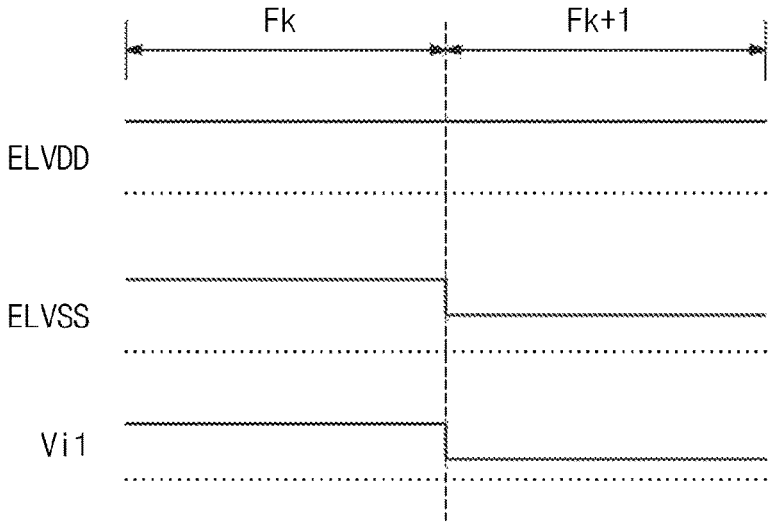
FIG. 3B is a voltage level diagram showing voltages according to an exemplary embodiment.
Figure 3C:
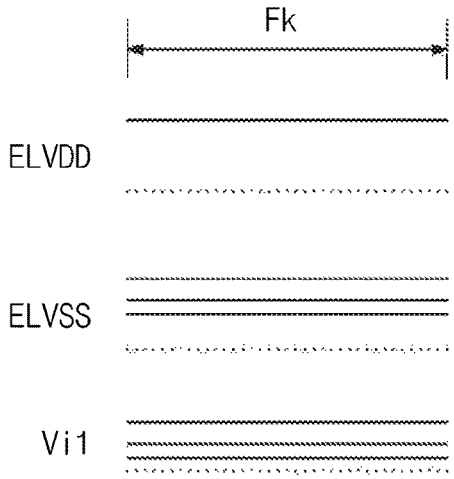
FIG. 3C is a voltage level diagram showing voltages according to an exemplary embodiment.

FIG. 1 is a block diagram showing an organic light-emitting diode (OLED) display according to an exemplary embodiment. FIG. 2 is a circuit diagram showing a first discharge voltage according to an exemplary embodiment. FIG. 3A is a circuit diagram showing a second discharge voltage according to an exemplary embodiment. FIG. 3B is a voltage level diagram showing voltages according to an exemplary embodiment. FIG. 3C is a voltage level diagram showing voltages according to an exemplary embodiment.

Referring to FIG. 1, the OLED display includes a timing controller 100, a scan driver 200, a data driver 300, a driving voltage generator 400, a discharge voltage generator 500, and a display panel DP.

The timing controller 100 can receive input image signals (not shown) and convert a data format of the input image signals to a data format appropriate to an interface between the data driver 300 and the timing controller 100 to generate image data RGB. The timing controller 100 can output the image data RGB and various control signals DCS, SCS, and VCS.

The scan driver 200 can receive a scan control signal SCS from the timing controller 100. The scan control signal SCS can include a vertical start signal that starts an operation of the scan driver 200 and a clock signal that determines an output timing of signals. The scan driver 200 can generate a plurality of scan signals and sequentially apply the scan signals to a plurality of scan lines SL1 to SLn described later. In addition, the scan driver 200 can generate a plurality of light-emitting control signals in response to the scan control signal SCS and apply the light-emitting control signals to a plurality of light-emitting lines EL1 to ELn described later.

In FIG. 1, the scan signals and the light-emitting control signals are output from one scan driver 200, but the number of the scan driver 200 should not be limited to one. According to embodiments, the scan signals and the light-emitting control signals can be output from plural scan drivers. In addition, a driving circuit that generates the scan signals and a driving circuit that generates the light-emitting control signals can be separately formed.

The data driver 300 can receive the data control signal DCS and the image data RGB from the timing controller 100. The data driver 300 can convert the image data RGB to data signals and apply the data signals to a plurality of data lines DL1 to DLm described later. The data signals can be analog signals corresponding to gray-scale values of the image data RGB.

The driving voltage generator 400 can receive a power voltage Vin from a power supply (not shown). The driving voltage generator 400 can convert the power voltage Vin to a first voltage ELVDD and a second voltage ELVSS having a voltage level lower than that of the first voltage ELVDD.

The driving voltage generator 400 can include a DC-DC converter. The driving voltage generator 400 can include a boosting converter that boosts up the power voltage Vin so as to generate the first voltage ELVDD. In addition, the driving voltage generator 400 can include a buck converter that falls down the power voltage Vin so as to generate the second voltage ELVSS.

The driving voltage generator 400 can receive the driving voltage control signal VCS from the timing controller 100. The driving voltage generator 400 can generate the first voltage ELVDD having a predetermined voltage level in response to the driving voltage control signal VCS.

The driving voltage generator 400 can generate the second voltage ELVSS having a predetermined voltage range in response to the driving voltage control signal VCS. The second voltage ELVSS can have a negative voltage within a range of about −4 volts to about −2 volts. The driving voltage generator 400 can selectively generate the second voltage ELVSS having about −4 volts, about −3 volts, or about −2 volts in response to the driving voltage control signal VCS.

As described later with reference to FIGS. 3B and 3C, the driving voltage generator 400 can generate the second voltage ELVSS having different voltage levels in accordance with frame periods. In addition, the driving voltage generator 400 can generate second voltages ELVSS having different voltage levels from each other in the predetermined voltage range. For instance, the driving voltage generator 400 can generate at least two second voltages among the second voltage ELVSS at about −4 volts, the second voltage ELVSS at about −3 volts, and the second voltage ELVSS at about −2 volts. In this case, the driving voltage generator 400 includes a plurality of buck converters.

In addition, the driving voltage generator 400 can generate various reference voltages required to drive the display device. For instance, the driving voltage generator 400 can generate a reference voltage needed to drive the display panel DP and a reference voltage needed to drive the discharge voltage generator 500.

The discharge voltage generator 500 can receive the first voltage ELVDD and the second voltage ELVSS from the driving voltage generator 400. The discharge voltage generator 500 can generate a third voltage Vi2 and a fourth voltage Vi1 using the first and second voltages ELVDD and ELVSS. The third and fourth voltages Vi2 and Vi1 can be discharge voltages different from each other. The discharge voltage generator 500 can generate a plurality of third voltages Vi2 and a plurality of fourth voltages Vi1 using the first and second voltages ELVDD and ELVSS.

The third voltage Vi2 can have a voltage level lower than that of the data signal. For instance, the third voltage Vi2 can have the voltage level lower than the data signal at a highest gray-scale value. The fourth voltage Vi1 can have an electric potential difference with respect to the second voltage ELVSS. For example, when the second voltage ELVSS has the voltage level of about −4 volts to about −2 volts, the fourth voltage Vi1 can have the voltage level of about −3 volts to about −1 volts.

Referring to FIG. 1 again, the display panel DP includes the scan lines SL1 to SLn, the light-emitting lines EL1 to ELn, the data lines DL1 to DLm, and the pixels PX. The scan lines SL1 to SLn extend in a first direction DR1 and are arranged in a second direction DR2 crossing the first direction DR1. Each of the light-emitting lines EL1 to ELn is arranged substantially parallel to a corresponding one of the scan lines SL1 to SLn. The data lines DL1 to DLm are insulated from the scan lines SL1 to SLn while crossing the scan lines SL1 to SLn.

Each of the pixels PX is connected to a corresponding scan line of the scan lines SL1 to SLn, a corresponding one of the light-emitting lines EL1 to ELn, and a corresponding one of the data lines DL1 to DLm. Although briefly shown in FIG. 1, each of the pixels PX can be connected to several scan lines of the scan lines SL1 to SLn. This will be described later with reference to FIGS. 4 and 5.

Each of the pixels PX includes an OLED (not shown) and a pixel circuit (not shown) that controls light emission of the OLED. The pixel circuit includes a plurality of thin film transistors (TFTs) and a capacitor. The pixels PX include red pixels representing the color red, green pixels representing the color green, and blue pixels representing the color blue. The OLEDs of the red, green, and blue pixels can include different organic light-emitting layers formed of different materials.

The scan lines SL1 to SLn, the light-emitting lines EL1 to ELn, the data lines DL1 to DLm, and the pixels PX are formed on a base substrate (not shown) through several photolithographic processes and several deposition processes. A sealing layer (not shown) can be further formed on the base substrate to substantially protect the pixels PX.

The display panel DP receives the first and second voltages ELVDD and ELVSS. The first voltage ELVDD is applied to the pixels PX through a first voltage line PL1. The second voltage ELVSS is applied to the pixels PX through electrodes (not shown) or power source lines (not shown), which are formed on the display panel DP.

In some embodiments, the pixels PX are applied with the second voltage ELVSS having the substantially constant voltage level. In addition, the pixels PX can be applied with the second voltages ELVSS having different voltage levels from each other in accordance with the colors represented therethrough. For instance, the red, green, and blue pixels receive the second voltages ELVSS having different voltage levels.

As shown in FIG. 2, the discharge voltage generator 500 includes a first discharge voltage generator or a voltage divider 500-1 to generate the third voltage Vi2. The first discharge voltage generator 500-1 includes a voltage dividing circuit that receives the first and second voltages ELVDD and ELVSS and generates the third voltage Vi2 divided from the first and second voltages ELVDD and ELVSS. The first discharge voltage generator 500-1 can include a plurality of voltage dividing circuits, each generating the third voltage Vi2.

The voltage dividing circuit includes a plurality of resistors electrically connected in series between the first voltage ELVDD and the second voltage ELVSS. As shown in FIG. 2, the voltage dividing circuit includes a first resistor R1 and a second resistor R2, which are electrically connected in series between the first voltage ELVDD and the second voltage ELVSS. The first resistor R1 is connected to the first voltage ELVDD and the second resistor R2 is electrically connected to the second voltage ELVSS. The third voltage Vi2 is output from a node NV between the first and second resistors R1 and R2. The voltage level of the third voltage Vi2 is determined depending on a resistance ratio of the first and second resistors R1 and R2.

In some embodiments, the first discharge voltage generator 500-1 can be omitted. In this case, the third voltage Vi2 can be generated by the buck converter of the driving voltage generator 400.

Referring to FIG. 3A, the discharge voltage generator 500 includes a second discharge voltage generator 500-2 that generates the fourth voltage Vi1. The second discharge voltage generator 500-2 includes a differential amplifier AMP to output a voltage difference between the reference voltage Vref provided from the driving voltage generator 400 and the second voltage ELVSS as the fourth voltage Vi1.

As shown in FIG. 3A, the differential amplifier AMP includes an inverting input terminal that receives the reference voltage Vref, a non-inverting input terminal that receives the second voltage ELVSS, and an output terminal that outputs the fourth voltage Vi1. The reference voltage Vref is electrically connected to the inverting input terminal through a first resistor R10. A second resistor R20 is electrically connected between the inverting input terminal and the output terminal. The second voltage ELVSS is electrically connected to the non-inverting input terminal through a third resistor R30. A fourth resistor R40 is electrically connected between the inverting input terminal and a ground terminal.

The differential amplifier AMP outputs the voltage difference between the reference voltage Vref and the second voltage. The voltage difference is substantially proportional to the resistance ratio of the first and second resistors R10 and R20. That is, the voltage level of the fourth voltage Vi1 can be controlled by adjusting the resistance ratio of the first and second resistors R10 and R20.

Although not shown separately, the second discharge voltage generator 500-2 can further include a voltage follower to apply the reference voltage Vref to the differential amplifier AMP. The voltage follower can provide a stable reference voltage Vref. The differential amplifier can directly receive the reference voltage Vref from the driving voltage generator 400 or receive a buffered reference voltage Vref through the voltage follower.

The differential amplifier can generate the fourth voltage Vi1 having different voltage levels in accordance with the frame periods. On the basis of the second voltage ELVSS varied in accordance with the frame periods, the differential amplifier AMP can generate the fourth voltage Vi1 having a substantially constant electric potential difference with respect to the second voltage ELVSS regardless of the frame periods.

Referring to FIG. 3B, the second discharge voltage generator 500-2 generates the fourth voltage Vi1 based on the second voltage ELVSS provided in a k-th and a (k+1)th frame period Fk and Fk+1. The voltage level of the fourth voltage Vi1 of the k-th frame period Fk is lower than that of the k-th frame period Fk. The fourth voltage Vi1 is based on the second voltage ELVSS, which has a voltage level in the (k+1)th frame Fk+1 lower than that of the k-th frame period Fk. FIG. 3B shows two consecutive frame periods Fk and Fk+1, but the differential amplifier can generate the fourth voltage Vi1 having different voltage levels in non-consecutive frame periods.

The second discharge voltage generator 500-2 can generate a plurality of fourth voltages Vi1 having different voltage levels from each other. To this end, the second discharge voltage generator 500-2 can include a plurality of differential amplifiers to generate the fourth voltages Vi1 having different voltage level.

Referring to FIG. 3C, the second discharge voltage generator 500-2 generates three fourth voltages Vi1. Each of the fourth voltages Vi1 has a voltage difference from a corresponding second voltage ELVSS during the k-th frame period Fk. When the voltage levels of the second voltages ELVSS are changed in the frame periods, the voltage levels of the fourth voltages Vi1 can be changed according to the voltage levels of the second voltages ELVSS.

The display panel DP receives the third and fourth voltages Vi2 and Vi1. The third voltage Vi2 is applied to the pixels PX through a second voltage line PL2. The fourth voltage Vi1 is applied to the pixels PX through a third voltage line PL3. The display panel DP receives the fourth voltages Vi1 having the different voltage levels in accordance with the frame periods.

In some embodiments, the pixels PX are applied with the fourth voltages Vi1 having the different voltage levels from each other according to the colors represented therethrough. In this case, the third voltage line PL3 includes a voltage line to apply one of the fourth voltages Vi1 to the red pixels, a voltage line to apply another one of the fourth voltages Vi1 to the green pixels, and the other one of the fourth voltages Vi1 to the blue pixels.

Figure 4:
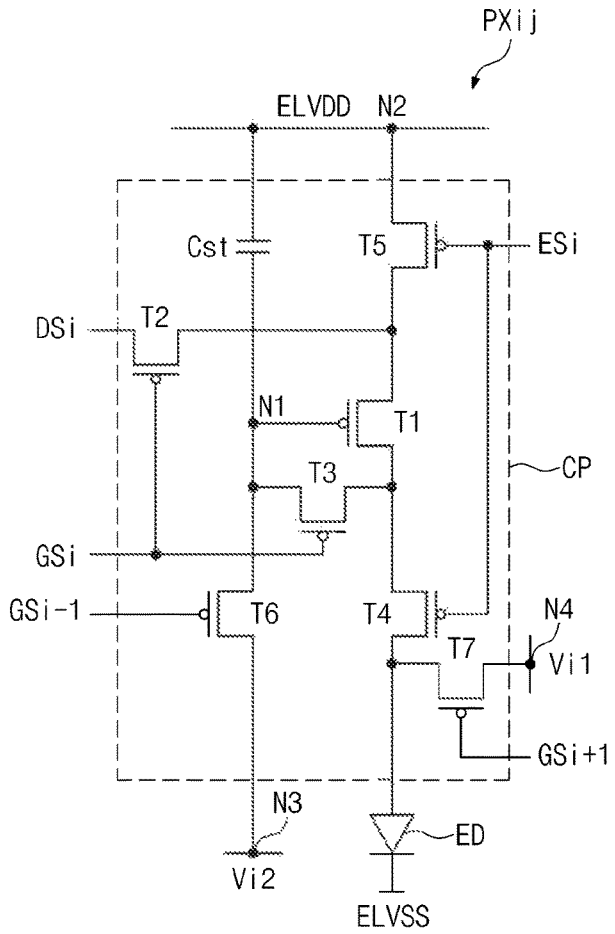
FIG. 4 is an equivalent circuit diagram showing a pixel according to an exemplary embodiment.
Figure 5:
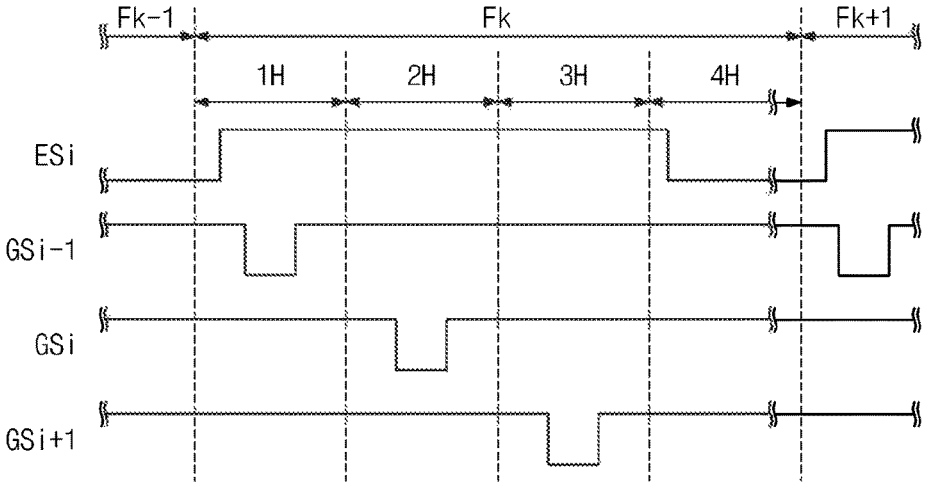
FIG. 5 is a waveform diagram showing driving signals required to drive the pixels shown in FIG. 4.

FIG. 4 is an equivalent circuit diagram showing a pixel according to an exemplary embodiment. FIG. 5 is a waveform diagram showing driving signals that drive the pixels shown in FIG. 4.

FIG. 4 shows the equivalent circuit diagram of a pixel PXij connected to an i-th scan line (not shown) of the scan lines SL1 to SLn, an i-th light-emitting line (not shown) of the light-emitting lines EL1 to ELn, and a j-th data line (not shown) of the data lines DL1 to DLm (refer to FIG. 1). Each of the pixels PX shown in FIG. 1 has the equivalent circuit shown in FIG. 4.

The pixel PXij includes the OLED ED and the pixel circuit CP that controls the OLED ED. In some embodiments, the pixel circuit CP includes seven transistors T1 to T7 and one capacitor Cst. In addition, each of the seven transistors T1 to T7 is a p-type transistor, but it should not be limited thereto or thereby.

Referring to FIG. 4, the pixel circuit CP includes a first transistor T1 connected between a node N2 (hereinafter, referred to as a second node) applied with the first voltage ELVDD and an anode of the OLED ED. The pixel circuit CP also includes a second transistor T2 connected between the j-th data line and the first transistor T1, a third transistor T3 connected between the first node N1 and an output electrode of the first transistor T1, and a fourth transistor T4 connected between the first transistor T1 and the anode of the OLED ED. In addition, the pixel circuit CP includes a fifth transistor T5 connected between the second node N2 and the first transistor T1, a sixth transistor T6 connected between the first node N1 and a third node N3 applied with the third voltage Vi2 (refer to FIG. 1), a seventh transistor T7 connected between the anode of the OLED ED and a fourth node N4 applied with the fourth voltage Vi1 (refer to FIG. 1), and a storage capacitor Cst connected between the first node N1 and the second node N2.

The second node N2 is connected to the first voltage line PL1 (refer to FIG. 1) and an input electrode of the fifth transistor T5. The third node N3 is connected to the second voltage line PL2 (refer to FIG. 2) and an input electrode of the sixth transistor T6. The fourth node N4 is connected to the third voltage line PL3 (refer to FIG. 1) and an input electrode of the seventh transistor T7.

The first transistor T1 includes an input electrode applied with the first voltage ELVDD through the fifth transistor T5, a control electrode connected to the first node N1, and an output electrode connected to the first node N1. The output electrode of the first transistor T1 can apply the first voltage ELVDD to the OLED ED through the fourth transistor T4.

The first transistor T1 can control a driving current provided to the OLED ED in response to a voltage of the first node N1. The first transistor T1 can be referred to as a driving transistor.

The second transistor T2 includes an input electrode connected to the j-th data line, a control electrode connected to the i-th scan line, and an output electrode connected to the input electrode of the first transistor T1. The second transistor T2 is turned on in response to the scan signal GSi applied to the i-th scan line and applies the data signal DSi applied to the j-th data line to the first node N1. The second transistor T2 can be referred to as a switching transistor.

The third transistor T3 includes an input electrode connected to the output electrode of the first transistor T1, a control electrode connected to the i-th scan line, and an output electrode connected to the first node N1. The third transistor T3 is turned on in response to the scan signal GSi applied to the i-th scan line. The third transistor T3 can be referred to as a first control transistor.

When the second and third transistors T2 and T3 are turned on, the first transistor T1 is connected between the second and third transistors T2 and T3 as a diode. Accordingly, the second transistor T2 is connected to the first node N1 through the first and third transistors T1 (acting as a diode) and T3.

The fourth transistor T4 includes an input electrode connected to the output electrode of the first transistor T1, a control electrode connected to the i-th light-emitting line, and an output electrode connected to the anode of the OLED ED.

The fourth transistor T4 is turned on or off in response to the light-emitting control signal ESi received from the i-th light-emitting line. A current path is formed or between the second node N2 and the OLED ED depending on an operation of the fourth transistor T4. The fourth transistor T4 can be referred to as a second control transistor.

The fifth transistor T5 includes an input electrode connected to the second node N2, a control electrode connected to the i-th light-emitting line, and an output electrode connected to the input electrode of the first transistor T1. The fifth transistor T5 can be referred to as a third control transistor.

The fifth transistor T5 is turned on or off in response to the light-emitting control signal ESi received from the i-th light-emitting line. A current path is formed between the second node N2 and the OLED ED depending on an operation of the fifth transistor T5. In some embodiments, the fifth transistor T5 is omitted, and in this case, the input electrode of the first transistor T1 is directly connected to the second node N2.

The sixth transistor T6 includes an input electrode applied with the third voltage Vi2, a control electrode applied with a first discharge control signal GSi−1, and an output electrode connected to the anode of the OLED ED. The sixth transistor T6 is turned on in response to the first discharge control signal GSi−1 and applies the third voltage Vi2 to the first node N1.

The first node N1 can be initialized to the first voltage Vi2. The sixth transistor T6 can be referred to as a second discharge transistor. In embodiments, the sixth transistor T6 is omitted.

The seventh transistor T7 includes an input electrode applied with the fourth voltage Vi1, a control electrode applied with a second discharge control signal GSi+1, and an output electrode connected to the anode of the OLED ED. The seventh transistor T7 is turned on in response to the second discharge control signal GSi+1 and applies the fourth voltage Vi1 to the anode of the OLED ED.

The anode of the OLED ED can be initialized to the fourth voltage Vi1. The seventh transistor T7 can be referred to as a first discharge transistor.

The storage capacitor Cst is connected between the first node N1 and the second node N2. The storage capacitor Cst can be charged with a voltage corresponding to the difference between the first voltage ELVDD and the voltage applied to the first node N1.

Referring to FIG. 5, the display device displays an image every frame period Fk−1, Fk, and Fk+1. Each of the pixels PX shown in FIG. 1 receives the data signal corresponding to the image every frame period Fk−1, Fk, and Fk+1. Every frame can include first and second discharge periods, a scanning period, and a light-emitting period.

FIG. 5 shows the frame periods Fk−1, Fk, and Fk+1 of the pixel PXij shown in FIG. 4. Hereinafter, the driving signals used to drive the pixels PX in the k-th frame period Fk will be described in detail. The k-th frame period Fk includes consecutive first, second, third, and fourth periods 1H, 2H, 3H, and 4H, but it should not be limited thereto or thereby. That is, the k-th frame period Fk can further include other periods in addition to the first to fourth periods 1H 4H.

The first discharge control signal GSi−1 can turn on the transistors in the first period 1H. In some embodiments, the signals can activate or turn on the corresponding transistors when they are at a low level below the threshold voltage. The low level of the signals shown in FIG. 5 can be a turn-on voltage of the transistor to which a corresponding signal of the signals is applied.

The first node N1 is initialized to the third voltage Vi2 by the first discharge control signal GSi−1 activated in the first period 1H. That is, the first discharge control signal GSi−1 has an active voltage level (e.g. low voltage level) in the first period 1H. The first period 1H corresponds to the second discharge period. The first discharge control signal GSi−1 has a non-active voltage level (e.g. high voltage level) in the other periods 2H to 4H.

The first discharge control signal GSi−1 can be the scan signal applied to the (i−1)th scan line among the scan lines SL1 to SLn (refer to FIG. 1).

The scan signal GSi activates in the second period 2H. The second transistor T2 is turned on by the activated scan signal GSi applied in the second period 2H. The data signal DSi applied to the j-th data line is applied to the first node N1. The second period 2H corresponds to a scanning period.

The anode of the OLED ED is initialized to the fourth voltage Vi1 by the second discharge control signal GSi+1 activated in the third period 3H following the second period 2H. The third period 3H corresponds to the first discharge period different from the second discharge period of the first period 1H.

The second discharge control signal GSi+1 can be the scan signal applied to the (i+1)th scan line among the scan lines SL1 to SLn.

The current path is formed between the second node N2 and the OLED ED by the light-emitting control signal ESi turning on the transistors T4 and T5 in the fourth period 4H following the third period 3H. Therefore, the OLED ED emits the light during the fourth period 4H. The fourth period 4H corresponds to a light-emitting period.

The light-emitting control signal ESi turns off the transistors T4 and T5 during the second and third periods 2H and 3H. That is, the light-emitting control signal ESi has a high level during the second and third periods 2H and 3H. The light-emitting control signal ESi has the high level before the first discharge control signal GSi−1 has the low level. In some embodiments, the light-emitting control signal ESi has the high level during the first period 1H.

Figure 6A:
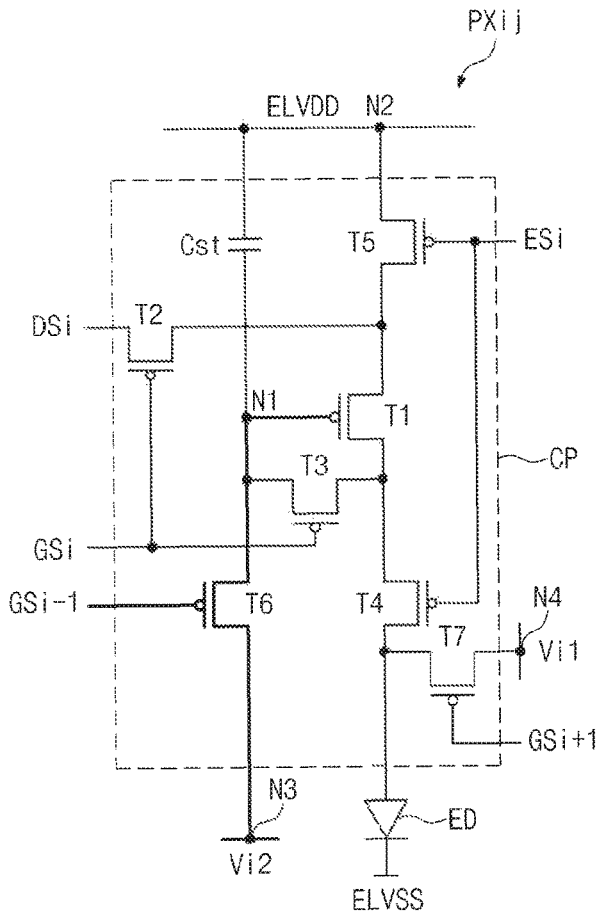
FIGS. 6A and 6B show an operation of the pixel and waveforms of the driving signals during a first period.
Figure 6B:
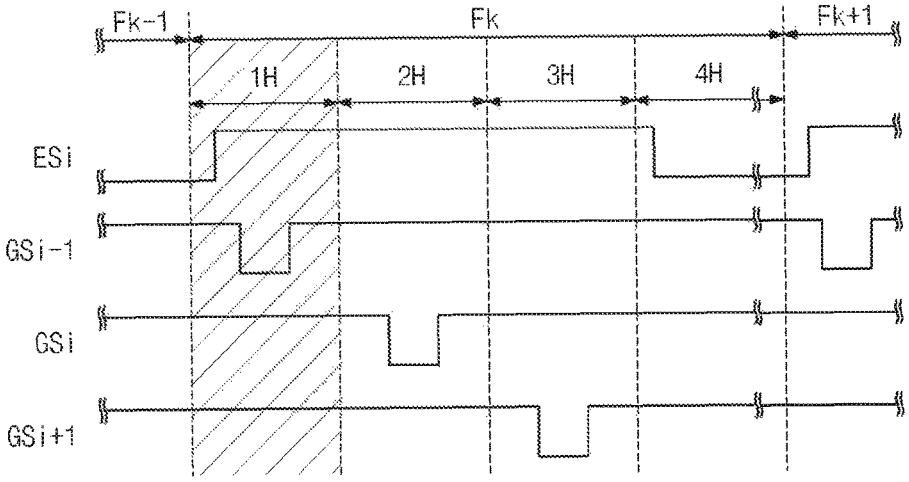
Figure 7A:
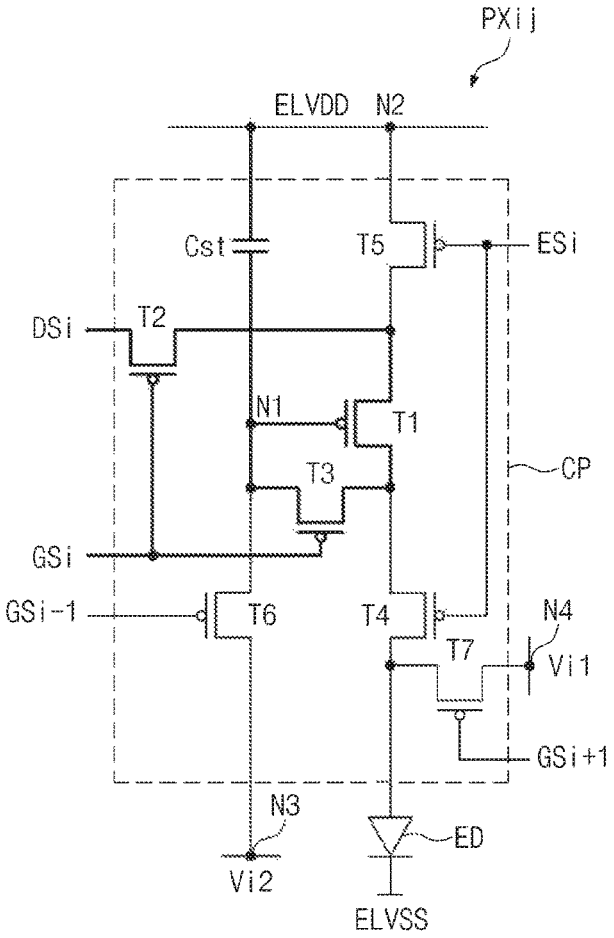
FIGS. 7A and 7B show an operation of the pixel and waveforms of the driving signals during a second period.
Figure 7B:
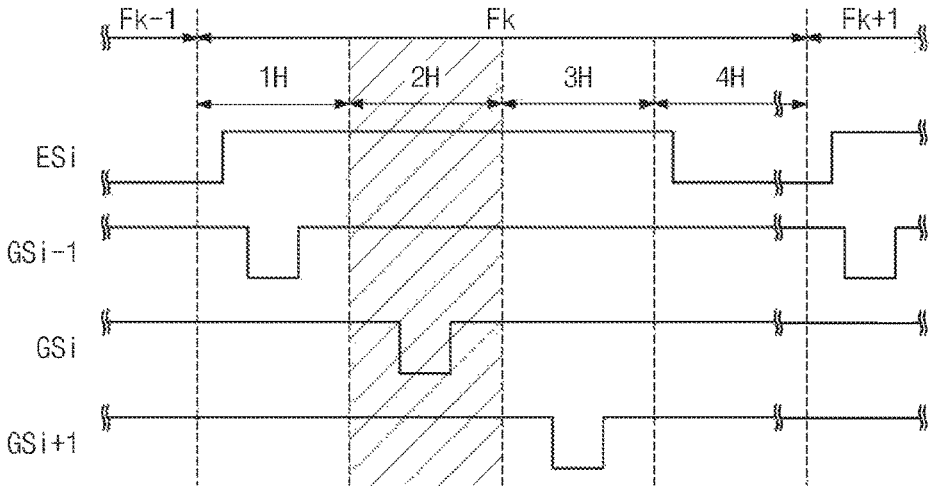
Figure 8A:
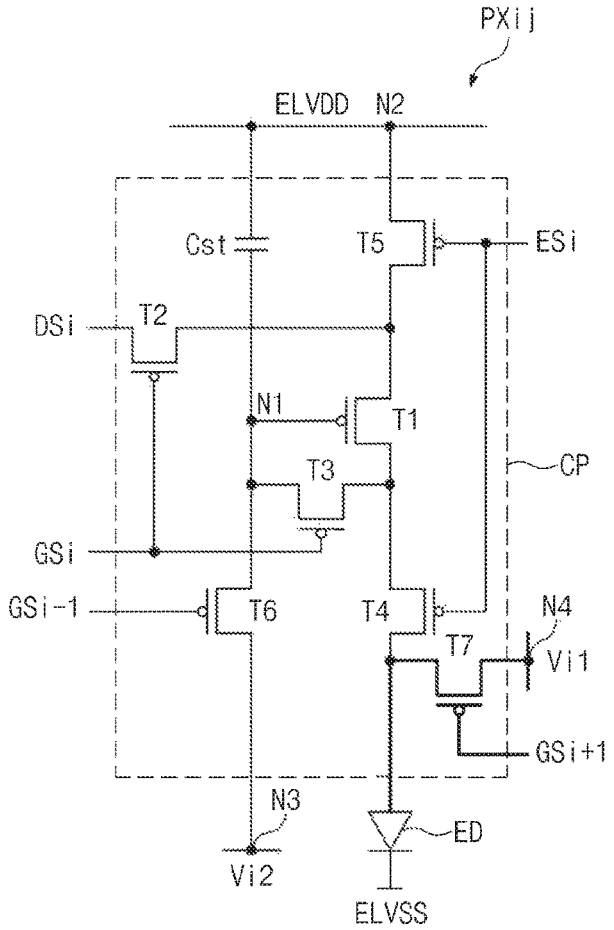
FIGS. 8A and 8B show an operation of the pixel and waveforms of the driving signals during a third period.
Figure 8B:
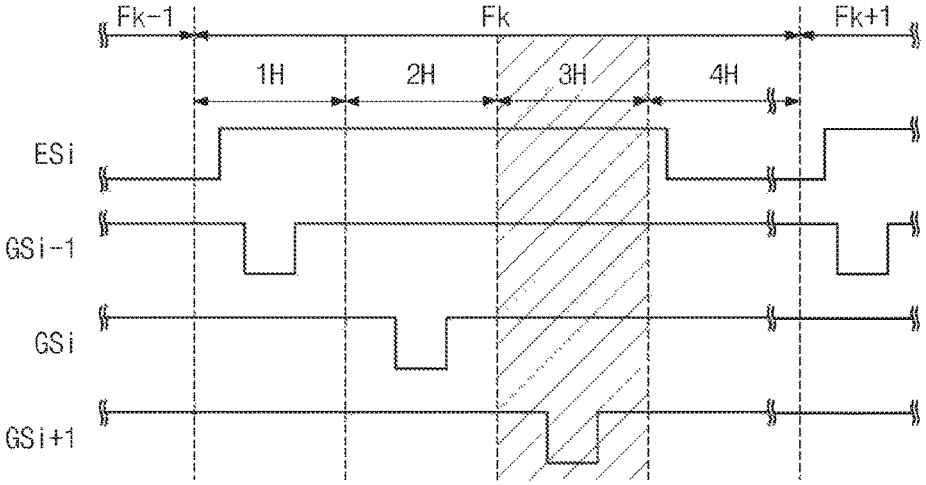
Figure 9A:
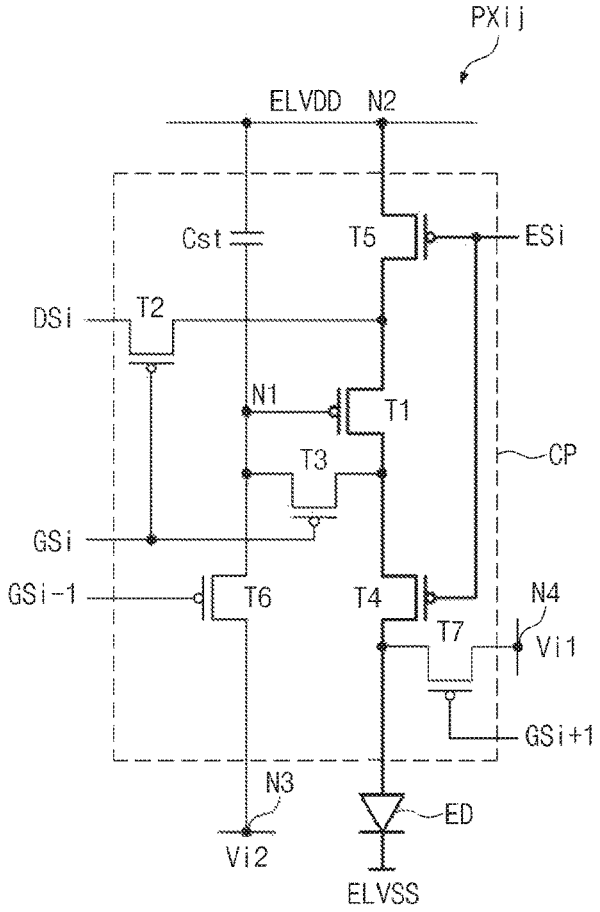
FIGS. 9A and 9B show an operation of the pixel and waveforms of the driving signals during a fourth period.
Figure 9B:
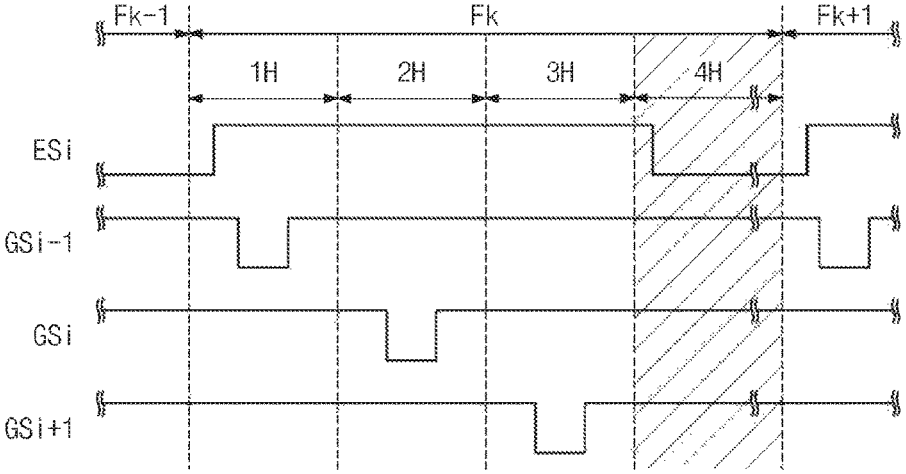

The operation of the pixel PXij will be described in detail with reference to FIGS. 6A, 6B, 7A, 7B, 8A, 8B, 9A, and 9B. FIGS. 6A and 6B show the operation of the pixel and waveforms of the driving signals during the first period. FIGS. 7A and 7B show the operation of the pixel and waveforms of the driving signals during the second period. FIGS. 8A and 8B show the operation of the pixel and waveforms of the driving signals during the third period. FIGS. 9A and 9B show the operation of the pixel and waveforms of the driving signals during the fourth period.

Referring to FIGS. 6A to 9B, a cathode of the OLED ED of the pixel PXij receives the second voltage ELVSS. The second voltage ELVSS has a voltage level selected from a predetermined voltage range in accordance with a mode of the display device. The voltage level of the second voltage ELVSS can be changed to correspond to the frame periods and/or in accordance with the color of the light emitted from the OLED ED.

Referring to FIGS. 6A and 6B, the first discharge control signal GSi−1 that has the low level in the first period 1H is applied to the sixth transistor T6. Thus, the third voltage Vi2 is applied to the first node N1. The third voltage Vi2 is low enough to initialize the first node N1. That is, the third voltage Vi2 is set to have a voltage level lower than that of the data signal at the highest gray-scale value by about the threshold voltage of the first transistor T1 or more.

Accordingly, the first transistor T1 is turned on during the first period 1H, and the first transistor T1 is diode-connected between the second and third transistors T2 and T3 during the second period 2H following the first period 1H.

Referring to FIGS. 7A and 7B, the scan signal GSi that has the low level in the second period 2H is applied to the i-th scan line. Therefore, the second and third transistors T2 and T3 are turned on, and the first transistor T1 is diode-connected by the third transistor T3.

During the second period 2H, the data signal is applied to the j-th data line. The data signal is applied to the first node N1 through the second transistor T2, the first transistor T1, and the third transistor T3. In this case, because the first transistor T1 is diode-connected, a voltage difference between the data signal and the threshold voltage of the transistor T1 is applied to the first node N1. The voltage applied to the first node N1 during the second period 2H is charged in the storage capacitor Cst.

Then, referring to FIGS. 8A and 8B, the second discharge control signal GSi+1 that has the low level in the third period 3H is applied to the control electrode of the seventh transistor T7. Accordingly, the seventh transistor T7 is turned on and the fourth voltage Vi1 is applied to the OLED ED. The anode of the OLED ED is initialized to the fourth voltage Vi1.

As described with reference to FIGS. 3A to 3C, the voltage level of the fourth voltage Vi1 can be determined by the selected voltage level of the second voltage ELVSS. In this case, the difference in electric potential between the fourth voltage Vi1 and the second voltage ELVSS is smaller than the threshold voltage of the OLED ED. Therefore, although the fourth voltage Vi1 is applied to the anode of the OLED ED, the OLED ED does not emit light. The pixel PXij displays a substantially uniform black brightness or image during the third period 3H regardless of the second voltage ELVSS.

Referring to FIGS. 9A and 9B, the light-emitting control signal ESi that has the low level in the fourth period 4H is applied to the i-th light-emitting line. Thus, the fourth and fifth transistors T4 and T5 are turned on. The current path is formed between the first voltage ELVDD and the second voltage ELVSS through the fifth transistor T5, the first transistor T1, the fourth transistor T4, and the OLED ED.

The driving current flowing through the OLED ED is controlled by the electric potential of the first node N1. The operation of the first transistor T1 is controlled by the data signal applied to the first node N1 during the second period 2H.

The OLED ED initialized by the fourth voltage Vi1 during the third period 3H emits light having the brightness corresponding to the data signal during the fourth period 4H. For instance, the OLED ED can substantially uniformly display the black brightness.

The pixel PXij applied with the data signal at a lowest gray-scale value can provide substantially the same brightness during the fourth period 4H as the brightness during the third period 3H. The pixel PXij can substantially uniformly display the black brightness regardless of the voltage level of the second voltage ELVSS. The pixel PXij can display low gray-scale values, each having a predetermined level of black brightness.

The OLEDs, which emit light having different colors, are kept turned off by the voltage difference between fourth voltage Vi1 and the second voltage ELVSS being less than the threshold voltage of the OLED. Thus, the OLEDs can uniformly display the black brightness regardless of their kind.

Although the inventive technology has been described, it is understood that the present invention should not be limited to these exemplary embodiments but various changes and modifications can be made by one ordinary skilled in the art within the spirit and scope of the present invention as hereinafter claimed.

What is claimed is:

1. An organic light-emitting diode (OLED) display comprising:

a plurality of scan lines;

a plurality of light-emitting lines;

a plurality of data lines crossing the scan lines and the light-emitting lines;

a plurality of pixels; and a voltage generator configured to output a third voltage and a fourth voltage different from the third voltage to the pixels, wherein each of the pixels includes:

a pixel circuit configured to receive a first voltage, the third voltage and the fourth voltage; and an OLED including an anode connected to the pixel circuit and a cathode configured to receive a second voltage having a voltage level lower than that of the first voltage, wherein the difference between the second voltage and the fourth voltage is substantially constant, and wherein the pixel circuit is configured to apply the fourth voltage to the anode.

2. The OLED display of claim 1, wherein the pixel circuit comprises:

a driving transistor electrically connected between a second node applied with the first voltage and the anode of the OLED, wherein the driving transistor has i) a control electrode electrically connected to a first node applied with the third voltage, ii) an input electrode, and iii) an output electrode;

a switching transistor including i) an input electrode configured to receive a data signal applied to a corresponding data line of the data lines, ii) an output electrode electrically connected to the input electrode of the driving transistor, and iii) a control electrode configured to receive a first scan signal applied to a corresponding scan line of the scan lines;

a storage capacitor electrically connected between the first node and the second node;

a first control transistor including i) an input electrode electrically connected to the output electrode of the driving transistor, ii) an output electrode electrically connected to the first node, and iii) a control electrode configured to receive the first scan signal applied to the corresponding scan line;

a second control transistor including i) an input electrode electrically connected to the output electrode of the driving transistor, ii) an output electrode electrically connected to the anode of the OLED, and iii) a control electrode electrically connected to a corresponding light-emitting line of the light-emitting lines applied with a first control signal; and a first discharge transistor including i) an input electrode configured to receive the fourth voltage, ii) an output electrode electrically connected to the anode of the OLED, and iii) a control electrode configured to receive a second control signal, wherein the first discharge transistor is configured to apply the fourth voltage to the anode of the OLED.

3. The OLED display of claim 2, wherein the second control signal comprises a second scan signal applied to a scan line subsequent to the corresponding scan line.

4. The OLED display of claim 2, wherein the pixel circuit further comprises a second discharge transistor including i) an input electrode configured to receive the third voltage having a voltage level less than that of the data signal applied to the corresponding data line, ii) an output electrode electrically connected to the first node, and iii) a control electrode configured to receive a third control signal, and wherein the second discharge transistor is configured to apply the third voltage to the control node.

5. The OLED display of claim 4, wherein the third control signal comprises a third scan signal applied to the scan line preceding the corresponding scan line.

6. The OLED display of claim 4, wherein the pixel circuit further comprises a third control transistor including i) an input electrode electrically connected to the second node, ii) an output electrode electrically connected to the input electrode of the driving transistor, and iii) a control electrode configured to receive the first control signal applied to the corresponding light-emitting line.

7. The OLED display of claim 1, wherein the voltage generator comprises a first voltage generator configured to generate the fourth voltage and comprising a differential amplifier including i) an inverting input terminal configured to receive a first reference voltage, ii) a non-inverting input terminal configured to receive a second reference voltage corresponding to the second voltage, and iii) an output terminal configured to output a voltage difference between the first reference voltage and the second reference voltage as the fourth voltage.

8. The OLED display of claim 1, wherein the voltage generator comprises a second voltage generator configured to generate the third voltage and comprising a voltage dividing circuit including a plurality of resistors electrically connected in series between the first voltage and the second voltage so as to output the third voltage divided by the resistors.

9. The OLED display of claim 1, wherein the second voltage comprises a voltage level in a range of about −4 volts to about −2 volts.

10. The OLED display of claim 1, wherein the difference between the second voltage and the fourth voltage is less than a light-emitting threshold voltage of the OLED.

11. A pixel for an organic light-emitting diode (OLED) display, comprising:

an OLED including an anode and a cathode configured to receive a second voltage; and a pixel circuit configured to i) receive a first voltage, ii) apply a fourth voltage to the anode before the OLED emits the light in a frame period and iii) receive a third voltage different from the fourth voltage, wherein the difference between the second voltage and the fourth voltage is substantially constant during the frame period.

12. The pixel of claim 11, wherein the pixel circuit comprises:

a driving transistor electrically connected between the anode of the OLED and a second node applied with the first voltage, the driving transistor has i) a control electrode electrically connected to a first node applied with the third voltage, ii) an input electrode and iii) an output electrode;

a switching transistor including i) an input electrode configured to receive a data signal, ii) an output electrode electrically connected to the input electrode of the driving transistor, and iii) a control electrode configured to receive a scan signal;

a storage capacitor electrically connected between the first node and the second node;

a first control transistor including i) an input electrode electrically connected to the output electrode of the driving transistor, ii) an output electrode electrically connected to the first node, and iii) a control electrode configured to receive the scan signal;

a second control transistor including i) an input electrode electrically connected to the output electrode of the driving transistor, ii) an output electrode electrically connected to the anode of the OLED, and iii) a control electrode configured to receive a first control signal; and a first discharge transistor including i) an input electrode configured to receive the fourth voltage, ii) an output electrode electrically connected to the anode of the OLED, and iii) a control electrode configured to receive a second control signal, wherein the first discharge transistor is configured to apply the fourth voltage to the anode of the OLED before the OLED emits the light in the frame period.

13. The pixel of claim 12, wherein the pixel circuit further comprises a second discharge transistor including i) an input electrode configured to receive the third voltage, ii) an output electrode electrically connected to the first node, and iii) a control electrode configured to receive a third control signal, and wherein the second discharge transistor is configured to apply the third voltage to the first node before the OLED emits the light in the frame period.

14. The pixel of claim 13, wherein the pixel circuit further comprises a third control transistor including i) an input electrode electrically connected to the second node, ii) an output electrode electrically connected to the input electrode of the driving transistor, and iii) a control electrode configured to receive the first control signal.

15. The pixel of claim 12, wherein the third voltage has a voltage level lower than that of the data signal.

16. The pixel of claim 11, wherein the second voltage comprises a voltage level in a range of about −4 volts to about −2 volts.

17. The pixel of claim 11, wherein the difference between the second voltage and the fourth voltage is less than a light-emitting threshold voltage of the OLED.

* * * * *